US008882542B2

(12) United States Patent
Song

(10) Patent No.: US 8,882,542 B2
(45) Date of Patent: Nov. 11, 2014

(54) ELECTRICAL CONNECTION DEVICE

(75) Inventor: Xiao-Jun Song, Shanghai (CN)

(73) Assignee: Molex Incorporated, Lisle, IL (US)

( * ) Notice: Subject to any disclaimer, the term of this patent is extended or adjusted under 35 U.S.C. 154(b) by 148 days.

(21) Appl. No.: 13/395,595

(22) PCT Filed: Sep. 10, 2010

(86) PCT No.: PCT/CN2010/001392
§ 371 (c)(1),
(2), (4) Date: May 23, 2012

(87) PCT Pub. No.: WO2011/029277
PCT Pub. Date: Mar. 17, 2011

(65) Prior Publication Data

US 2012/0231661 A1 Sep. 13, 2012

(30) Foreign Application Priority Data

Sep. 11, 2009 (CN) ..... 2009 2 0177719 U

(51) Int. Cl.
*H01R 13/648* (2006.01)
*H01R 13/6595* (2011.01)
*H01R 12/57* (2011.01)

(52) U.S. Cl.
CPC ..... *H01R 13/6595* (2013.01); *H01R 12/57* (2013.01)
USPC ..... 439/607.4

(58) Field of Classification Search
USPC ..... 439/607.4, 607.13, 607.07, 607.09, 439/607.11, 95, 108; 219/121.64
See application file for complete search history.

(56) References Cited

U.S. PATENT DOCUMENTS 5,637,014 A * 6/1997 Sukegawa et al. ..... 439/607.4
6,794,603 B1 * 9/2004 Musselman ..... 219/121.64
6,986,681 B2 * 1/2006 Tsai ..... 439/607.36
7,077,703 B2 7/2006 Herlitz et al.

FOREIGN PATENT DOCUMENTS

CN 2641856 Y 9/2004
CN 101071912 A 11/2007
CN 201515098 U 6/2010
TW M276350 U 9/2005

OTHER PUBLICATIONS

International Search Report for PCT/CN2010/001392.

* cited by examiner

*Primary Examiner* — Phuongchi T Nguyen
(74) *Attorney, Agent, or Firm* — Stephen L. Sheldon

(57) ABSTRACT

A connector comprises an outer shell, an insulating body, a plurality of terminals provided in the insulating body, and an inner metal shell shielding the insulating body. The outer metal shell is sheathed outside the inner metal shell and has a top plate, wherein a top plate of the inner metal shell and a top plate of the outer metal shell can be firmly fixed together by a plurality of laser joints. The outer metal shell can include transverse soldering plates respectively at two sides thereof that are coplanar with a soldering surface associated with the plurality of terminals.

9 Claims, 7 Drawing Sheets

ELECTRICAL CONNECTION DEVICE

RELATED APPLICATIONS

This application claims priority to Chinese Application No. 200920177719.7, filed Sep. 11, 2009, and to PCT Application No. PCT/CN2010/001392, filed Sep. 10, 2010, both of which are incorporated herein by reference in their entirety.

TECHNICAL FIELD

The application relates to an electrical connection device, and more specifically, to an electrical connection device suitable for use in compact configurations.

BACKGROUND

Referring to FIG. 1, FIG. 1 illustrates a prior electrical connector, such as a Taiwan utility model patent publication No. M276350 (Application No. 094205123), which discloses a first shell 11, a second shell 12, and a terminal base 13. The terminal base 13 is provided with a plurality of terminals 14 and is covered in the first shell 11, the first shell 11 is provided with catching portions 111 respectively at two side walls thereof, and the second shell 12 is provided with latching portions 121 respectively at two side walls thereof. The latching portions 121 may be respectively correspondingly engaged with the catching portions 111 so that the second shell 12 may be fixed outside the first shell 11, and the second shell 12 is provided with connecting legs 122 respectively at left and right sides thereof, connecting legs 122 may be disposed to respectively pass through through-holes of a circuit board (not shown), so that the electrical connector may be fixedly soldered on the circuit board.

However, the first shell and the second shell of the electrical connector are assembled by a latching mode, and thus are not firmly fixed therebetween. Therefore, the first shell and the second shell are relatively shifted due to shock yielded from an external force (for example, if conveyed by a conveyer belt) during soldering the electrical connector to the circuit board. Accordingly, a through-hole type design must be adopted for the connecting legs of the second shell. If a Surface Mount Technology (SMT)-TYPE is alternatively used, it is easy to cause that the SMT-TYPE connecting legs of the second shell and the SMT-TYPE soldering portions of the terminals are not coplanar, and a problem of missing solder for the terminals of the electrical connector is possible, with the potential result that signal transmission will be poor. Secondly, also because the first shell and the second shell are assembled by the latching mode and not firmly fixed therebetween, there is a gap between the first shell and the second shell, so that most stress during inserting or withdrawing a mating counterpart connector is still born by the first shell when the mating counterpart connector is inserted into or withdrawn from the electrical connector, and in turn will be born by the soldering portions of the terminals, thereby easily making the electrical connector to be released, that is to say, there is a phenomenon that the terminals will be released. On the other hand, because the circuit board belongs to a multi-layer-sheet structure design, the number of the through-holes would influence on a wiring layout inside the circuit board. As a result, the connecting legs of the second shell disposed to respectively pass through the through-holes of the circuit board may make a problem on the wring layout design for the circuit board serious, and may result in increased cost. Consequentially, certain individuals would appreciate an improved connector.

SUMMARY

In an example an electrical connection device comprises a connector and an outer metal shell. The connector comprises an insulating body, a plurality of terminals provided in the insulating body, and an inner metal shell shielding the insulating body, and each of the terminals has a soldering portion, each of the soldering portions is formed with a first soldering surface. The outer metal shell is sheathed outside the inner metal shell, wherein: the inner metal shell of the connector has a top plate, the outer metal shell has a top plate, the top plate of the inner metal shell and the top plate of the outer metal shell are firmly fixed as a whole by a plurality of laser joints, and the outer metal shell has transverse soldering plates respectively at two sides of the outer metal shell, each of the transverse soldering plates has a second soldering surface, the first soldering surfaces of the terminals and the second soldering surfaces of the transverse soldering plates are coplanar.

In order to further understand features and technical contents of the present application, please referring to the following detailed description and accompanying drawings concerning the present application. However, the drawings is only provided as reference and description, and is not intended to limit for the present application.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated, on benefit of the depicted embodiments is that one can provide an electrical connection device capable of making an inner metal shell and an outer metal shell to be firmly fixed as a whole so that it may ensure that soldering plates of the outer metal shell and soldering portions of terminals of the connector are coplanar during soldering and accordingly may eliminate a problem of missing solder for the terminals. The soldering plates may be fixedly soldered on a board surface of a circuit board, and therefore the number of through-holes on the circuit board may be reduced, so as to lower the influence on a wiring layout inside the circuit board due to the number of the through-holes.

Another benefit is the ability to provide an electrical connection device capable of making an inner metal shell and an outer metal shell to be firmly fixed as a whole, so that stress yielded during inserting or withdrawing a mating counterpart connector is immediately born by both the inner metal shell and the outer metal shell, and therefore the connector is not easy to release.

Accordingly, as can be appreciated, certain embodiments can provide the beneficial effects of the top plate of the inner metal shell and the top plate of the outer metal shell being firmly fixed as a whole by the laser joints (which may eliminate the problem that they are not firmly fixed therebeween as provided in prior art). Consequentially it may help ensure that the SMT-TYPE soldering plates of the outer metal shell and the SMT-TYPE soldering portions of the terminals of the connector are coplanar during soldering and may eliminate the problem of missing solder for the terminals in prior art. And if the outer metal shell is firmly fixed on the board surface of the circuit board via the SMT-TYPE soldering plates then the number of the through-holes on the circuit board can be reduced and consequently it may lower the influence on the wiring layout inside the circuit board due to the number of the vias is the circuit board. In addition, when the top plate of the inner metal shell and the top plate of the outer metal shell are firmly fixed as a whole, stress yielded during inserting or withdrawing the mating counterpart connector is born by both the inner metal shell and the outer metal shell. This helps ensure the connector is not undesirably removed from the supporting circuit board during mating/un-mating cycles.

Figure 1:
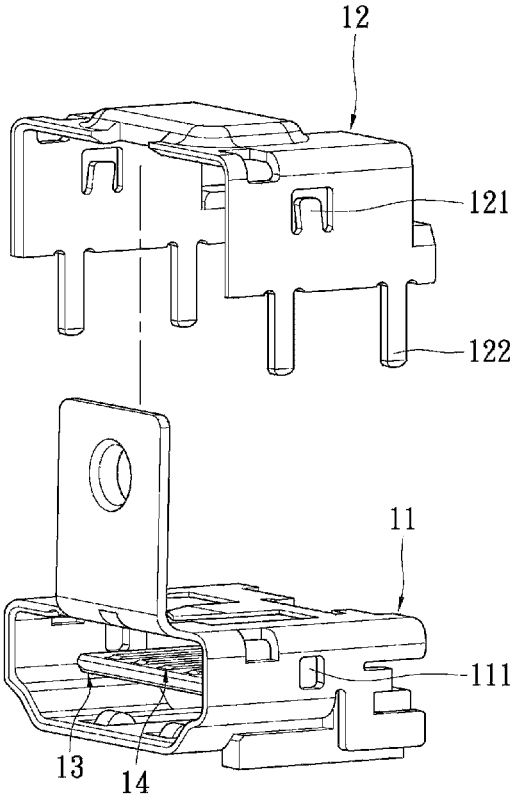
FIG. 1 is an exploded perspective view of an electrical connector in prior art.
Figure 2:
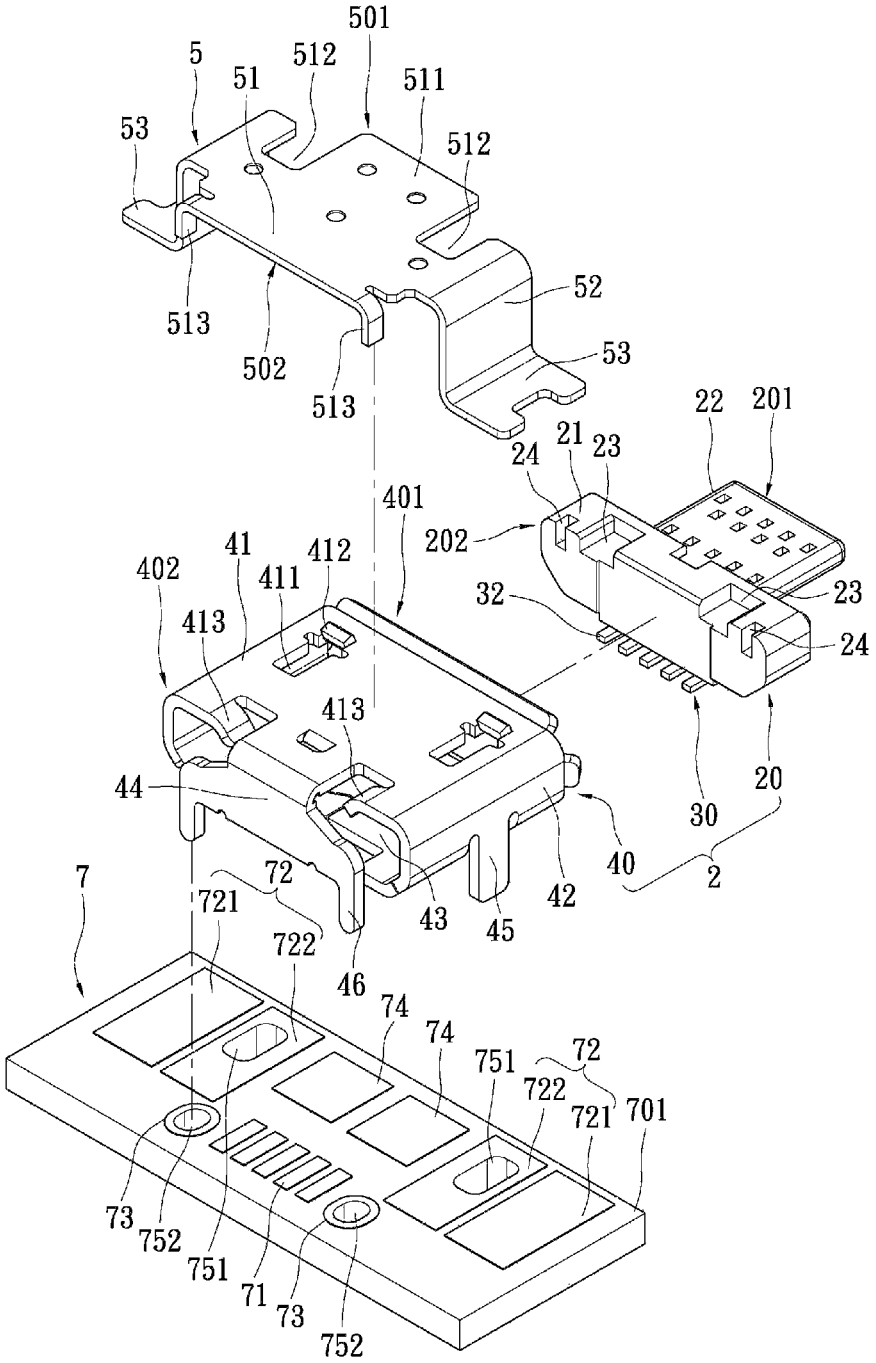
FIG. 2 is an exploded perspective view of an embodiment of an electrical connection device.
Figure 3:
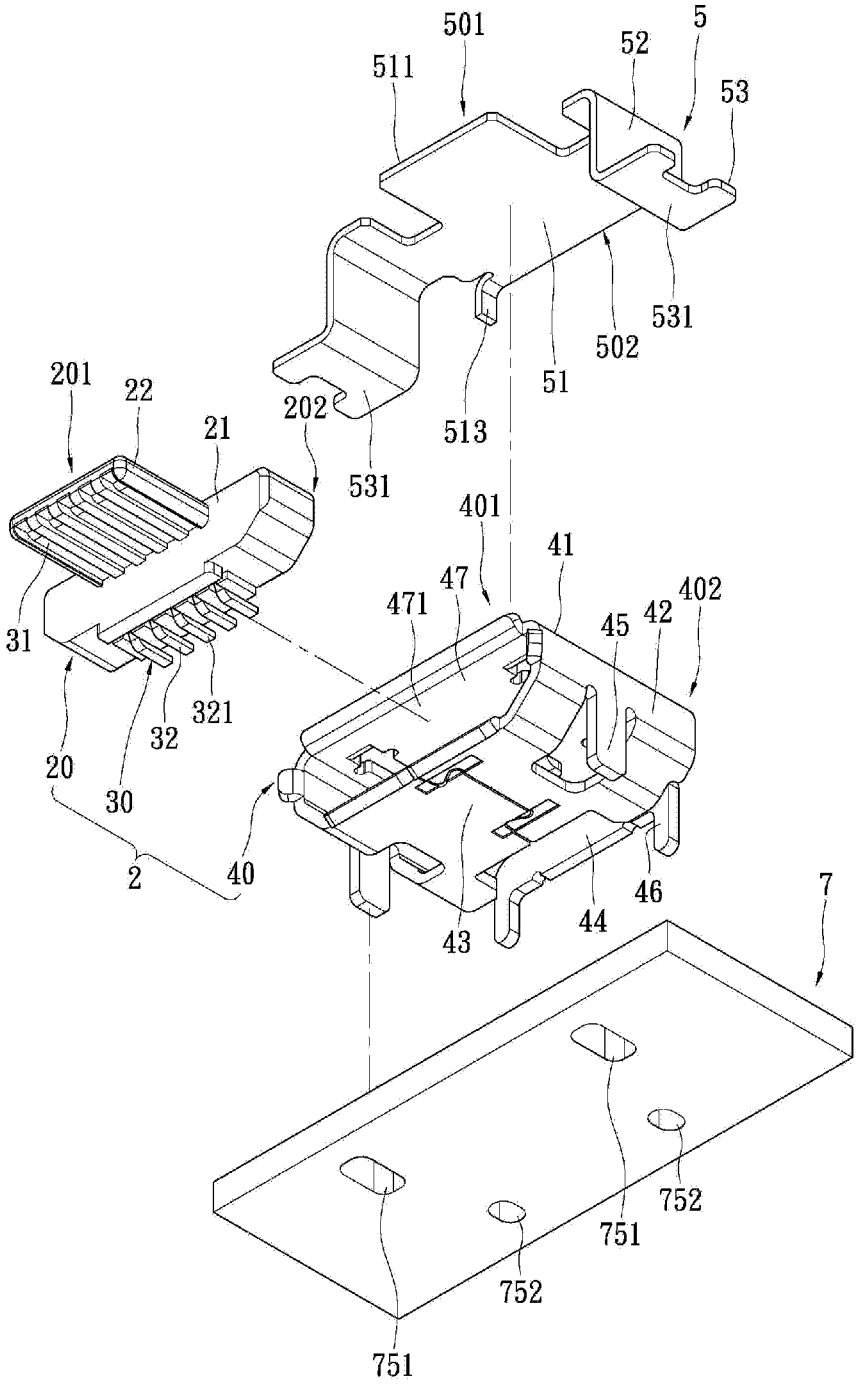
FIG. 3 is an exploded perspective view of the electrical connection device of FIG. 2 viewed from another angle.

Referring to FIG. 2 and FIG. 3, an electrical connection device, provided by the present application, comprises a connector 2 and an outer metal shell 5. The connector 2 comprises an insulating body 20, a plurality of terminals 30, and an inner metal shell 40. The insulating body 20 has a front end 201 and a rear end 202 which are opposite each other, and the insulating body 20 has a base body 21 and a tongue 22 extending forwards from a front end surface of the base body 21. Concave portions 23 are respectively concavely provided in a top portion of the insulating body 20 close to two sides of the insulating body 20 at the rear end 202; and preferably, the concave portions 23 are respectively provided in the top portion of the base body 21 close to two sides of the base body 21. Grooves 24 are respectively concavely provided in the top portion of the insulating body 20 close to the two sides of the insulating body 20 at the rear end 202, and preferably, the grooves 24 are respectively provided in the top portion of the base body 21 close to two sides of the base body 21.

As can be appreciated, each terminal 30 has a contacting portion 31 and a soldering portion 32, the soldering portion 32 has a first soldering surface 321 formed at a bottom thereof. It should be noted that the number of contacting portions can be provided as depicted (which is consistent with the USB standard) or some other number of contacts can be provided.

As depicted, the inner metal shell 40 has a front end 401 and a rear end 402 which are opposite each other, the front end 401 corresponds to the front end 201 of the insulating body 20, and the rear end 402 corresponds to the rear end 202 of the insulating body 20. And the inner metal shell 40 has a top plate 41, two side plates 42 connected to two sides of the top plate 41, a bottom plate 43 connected to bottom portions of the side plates 42, and a rear lid 44 connected to the top plate 41 connected to a rear end of the top plate 41. The inner metal shell 40 is further provided with lateral soldering legs 45 and rear soldering legs 46, the lateral soldering legs 45 are formed so as to extend downwards respectively from two side plates 42, and the rear soldering legs 46 are formed so as to extend downwards respectively from a bottom portion of the rear lid 44 close to two sides of the rear lid 44. The top plate 41 is provided with windows 411 respectively close to the two sides of the top plate 41 and close to the front end 401, and the top plate 41 is provided with protruding portions 412 respectively in front of the windows 411, and baffle plates 413 are foldedly provided in the top plate 41 respectively close to the two sides of the top plate 41 and close to the rear end 402.

The outer metal shell 5 has a front end 501 and a rear end 502 which are opposite each other, the front end 501 corresponds to the front end 401 of the inner metal shell 40, and the rear end 502 corresponds to the rear end 402 of the inner metal shell 40. And the outer metal shell 5 has a top plate 5, and two side plates 52 and two transverse soldering plates 53 at two sides thereof. The side plates 52 respectively extend from the two sides of the top plate 51, the soldering plates 53 are formed respectively by foldedly extending from distal ends of the side plates 52, and the soldering plates 53 respectively have second soldering surfaces 531 formed at bottom portions of the soldering plates 53. On the other hand, the top plate 51 further has an extending portion 511 extending forwards at the front end 501, evading openings 512 are formed respectively at two sides of the extending portion 511, and folding plates 513 are respectively formed so as to foldedly extend from the two sides of the top plate 51 close to the rear end 502.

Figure 4:
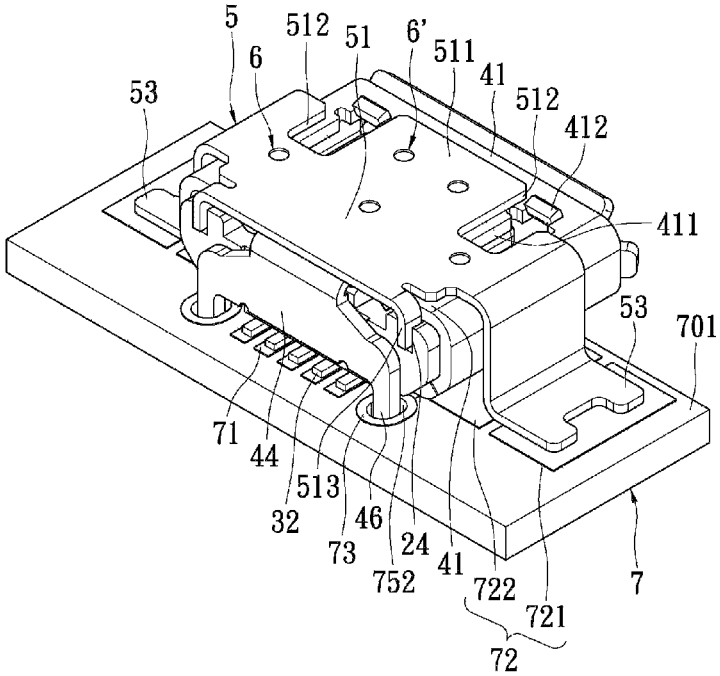
FIG. 4 is an assembled perspective view of an embodiment of an electrical connection device.
Figure 5:
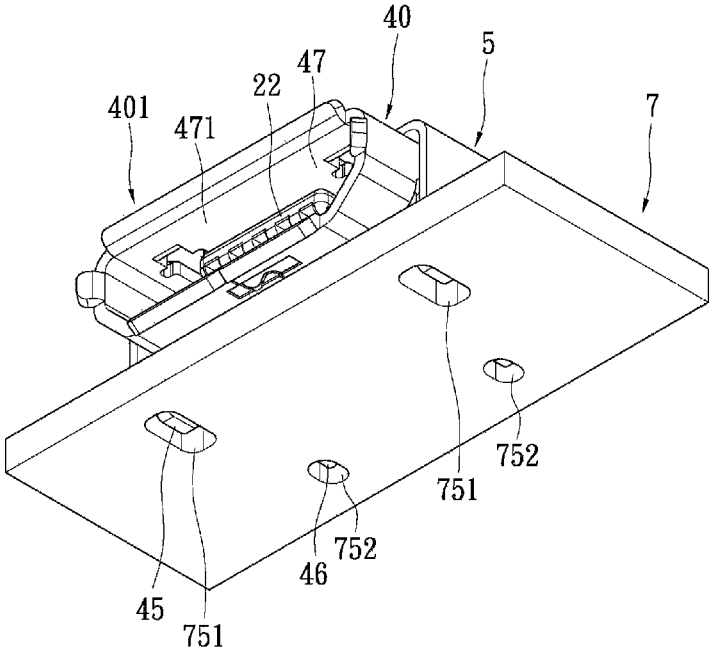
FIG. 5 is an assembled perspective view of an electrical connection device of FIG. 4 viewed from another angle.
Figure 6:
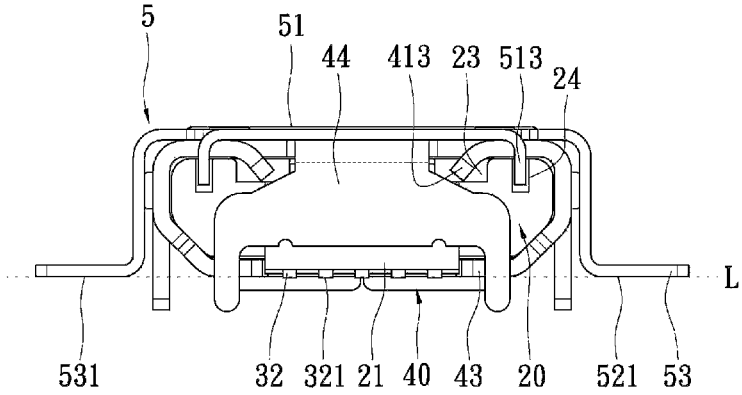
FIG. 6 is a rear view of an embodiment of an outer metal shell and a connector.

Furthermore, referring to FIGS. 4-6, each terminal 30 is provided in the insulating body 20, the contacting portion 31 of each terminal 30 is located on a surface of the tongue 22 (as shown in FIG. 3) and the soldering portion 32 of each terminal 30 is located on the bottom portion of the base body 21. The inner metal shell 40 shields the insulating body 20, and forms an inserting space 47 with an inserting opening 471 located at the front end 401 of the inner metal shell 40 (as shown in FIG. 5), the tongue 22 is located in the inserting space 47. The rear lid 44 of the inner metal shell 40 covers behind the base body 21 of the insulating body 20.

The outer metal shell 5 is sheathed outside the inner metal shell 40 of the connector 2. In the present application, the top plate 41 of the inner metal shell 40 and the top plate 51 of the outer metal shell 5 are soldered by a laser manner so as to form a plurality of laser joints 6 therebetween (as shown in FIG. 4), the top plate 41 of the inner metal shell 40 and the top plate 51 of the outer metal shell 5 are firmly fixed as a whole by means of the laser joints 6. And the second soldering surfaces 531 of the soldering plates 53 of the outer metal shell 5 and the first soldering surfaces 321 of the soldering portions 32 of the terminals 30 are coplanar (as a dashed line L shown in FIG. 6). As can be appreciated, the extending portion 511 of the outer metal shell 5 and the top plate 41 of the inner metal shell 40 can also be firmly fixed as a whole by at least one laser joint 6', so as to reinforce an effect of firmly fixing the inner metal shell 40 and the outer metal shell 5.

Further, the baffle plates 413 of the top plate 41 of the inner metal shell 40 are respectively inserted into the concave portions 23 of the insulating body 20, so as to baffle the insulating body 20. The folding plates 513 of the outer metal shell 5 will be respectively inserted into the grooves 24 of the insulating body 20, and will be baffled at a rear end surface of the top plate 41 of the inner metal shell 40. By baffling the folding plates 513 of the outer metal shell 5 at the rear end surface of the inner metal shell 40, when a mating counterpart connector (not shown) is inserted, the insulating body 20 can be prevented from withdrawing rearwards.

The evading openings 512 at the two sides of the extending portion 511 of the outer top plate 51 are respectively located above the windows 411 of the inner top plate 41 of the inner metal shell 40. Accordingly, when the mating counterpart connector (not shown) is inserted into the inserting space 47 from the inserting opening 471, engaging hooks (not shown) of the mating counterpart connector can be respectively resiliently snapped into the windows 411 and the evading openings 512 and in turn respectively engaged to the protruding plates 412.

Referring to FIG. 2 again, the connector 2 and the outer metal shell 5 are provided on a board surface 701 of a circuit board 7, and a plurality of first soldering pad portions 71 and two second soldering pad portions 72 are provided on the board surface 701. The soldering portion 32 of each terminal 30 is correspondingly disposed on the first soldering pad portion 71, and the soldering plates 53 of the outer metal shell 5 are respectively correspondingly disposed on the second soldering pad portions 72. The top plate 41 of the inner metal shell 40 and the top plate 51 of the outer metal shell 5 can be firmly fixed as a whole by the laser joints 6, this may, during soldering, ensure that the transverse soldering plates 53 of the outer metal shell 5 and the soldering portion 32 of the terminals 30 of the connector 2 are coplanar and assure that the first soldering surfaces 321 of the soldering portions 32 are able to be fixedly soldered respectively on the first soldering pad portions 71, so as to eliminate a problem of missing solder. In addition, the top plate 41 of the inner metal shell 40 and the top plate 51 of the outer metal shell 5 can be firmly fixed as a whole by the laser joints 6. Consequentially, when the mating counterpart connector (not shown) is inserted into or withdrawn from the electrical connection device, the stress yielded during inserting or withdrawing the mating counterpart connector is born by both the inner metal shell 40 and the outer metal shell 5, thereby preventing the connector 2 from being pulled from the circuit board 7. Moreover, the second soldering surfaces 531 of the soldering plates 53 of the outer metal shell 5 are respectively fixedly soldered on the second soldering pad portions 72 and the soldering plates 53 are SMT-TYPE soldering plates, therefore the number of the through-holes on the circuit board 7 may be reduced, so as to lower the influence on the wiring layout inside the circuit board 7 due to the number of the through-holes.

As depicted, the board surface 701 of the circuit board 7 can be provided with two third soldering pad portions 73 and at least one fourth soldering pad portion 74 provided thereon, and the circuit board 7 is further provided with a plurality of through-holes 751, 752 respectively disposed in the second soldering pad portions 72 and third soldering pad portions 73. The lateral soldering legs 45 at the two sides of the inner metal shell 40 are disposed to correspondingly respectively pass through the through-holes 751 of the second soldering pad portions 72 and in turn are fixedly soldered on the circuit board 7; the rear soldering legs 46 of the inner metal shell 40 are disposed to correspondingly respectively pass through the through-holes 752 of the third soldering pad portions 73 and in turn are fixedly soldered on the circuit board 7. In the present application, a bottom surface of the bottom plate 43 of the inner metal shell 40 and the first soldering surfaces 321 of the soldering portions 32 of the terminals 30 are coplanar, accordingly, the bottom surface of the bottom plate 43 of the inner metal shell 40 close to the front end 401 may be further fixedly soldered on the fourth soldering pad portions 74 of the circuit board 7 so as to further reinforce stability of the connector 2 fixed on the circuit board 7.

Figure 7:
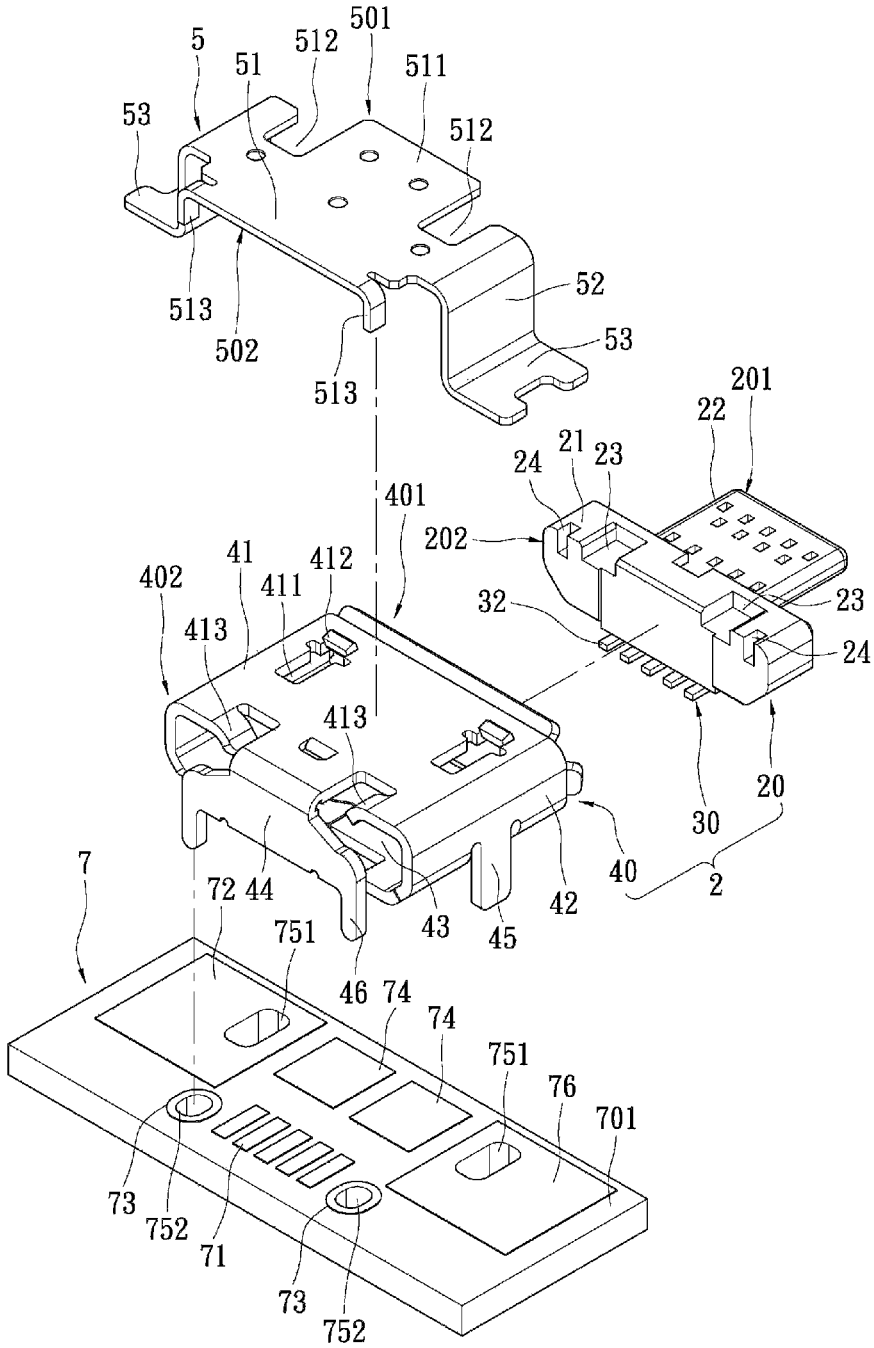
FIG. 7 is an exploded perspective view of another embodiment of an electrical connection device.

In addition, in this embodiment, each of the two second soldering pad portions 72 has a soldering pad 721 for the soldering plate 72 and a soldering pad 722 for the soldering leg 72, and the through-holes 751 provided in the second soldering pad portions 72 are respectively located in the soldering pads 722 for the soldering leg 72. The soldering plates 53 are respectively fixedly soldered on the soldering pads 721 for the soldering plates 72, and the lateral soldering legs 45 are disposed to respectively pass through the through-holes 751 located in the soldering pads 722 for the soldering legs 72. Referring to FIG. 7 again and combining with FIG. 2, in this embodiment, each of second soldering pad portions 76 is a soldering pad, specifically a single soldering pad formed by connecting the soldering pad 721 for the soldering plate 72 to the soldering pad 722 for the soldering leg 72 in the embodiment described above. Moreover, in the two embodiments described above, each of the first soldering pad portions 71, the third soldering pad portions 73, and the fourth soldering pad portions 74 is also a soldering pad.

As depicted, therefore, in certain embodiments the top plate of the inner metal shell and the top plate of the outer metal shell are firmly fixed as a whole by the laser joints, so as to eliminate the problem of non-firm fixation each other in prior art, and in turn ensure that SMT-TYPE soldering plates of the outer metal shell and the SMT-TYPE soldering portions of the terminals of the connector are coplanar during soldering, so as to eliminate the problem of missing solder for the terminals in prior art. Meanwhile, the top plate of the inner metal shell and the top plate of the outer metal shell can be firmly fixed together by the laser joints, the stress yielded during inserting or withdrawing the mating counterpart connector can be supported by both the inner metal shell and the outer metal shell, and thus the connector has a more secure attachment to the circuit board. Further, the outer metal shell is fixedly soldered on the board surface of the circuit board via the SMT-TYPE soldering plates, and therefore the number of the through-holes on the circuit board may be reduced, and the influence on the wiring layout inside the circuit board due to the number of the through-holes may be lowered.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. An electrical connector, comprising:

an insulating body;

a plurality of terminals provided in the insulating body, each of the terminal having a soldering portion formed with a first soldering surface;

an inner metal shell configured to shield the insulating body, the inner metal shell having a top plate; and an outer metal shell that extends around the inner metal shell, wherein the outer metal shell has a top plate and the top plate of the inner metal shell and the top plate of the outer metal shell are fixed together and the outer metal shell has transverse soldering plates respectively at two sides thereof, each of the transverse soldering plates has a second soldering surface, the first soldering surfaces of the terminals and the second soldering surfaces of the transverse soldering plates being coplanar wherein the top plate of the outer metal shell has side plates extending respectively from two sides thereof and the soldering plate is formed by foldedly extending a distal end of the side plate of the outer metal shell and wherein the inner metal shell has a front end and a rear end which are opposite each other, and forms an inserting space with an inserting opening located at the front end of the inner metal shell, the outer metal shell has a front end and a rear end which are opposite each other and respectively correspond to the front end and the rear end of the inner metal shell, the top plate of the outer metal shell has folding plates extending respectively from two sides thereof close to the rear end of the outer metal shell, the insulating body is concavely provided with grooves respectively in a top portion thereof close to two sides thereof, and the folding plates are correspondingly respectively inserted into the grooves and are baffled at a rear end surface of the top plate of the inner metal shell.

2. The electrical connector according to claim 1, wherein the top plate of the outer metal shell has an extending portion extending forwards from the top plate of the outer metal shell at the front end of the outer metal shell and the extending portion and the top plate of the inner metal shell are fixed together.

3. The electrical connector according to claim 2, further comprising a circuit board with a board surface, wherein the connector and the outer metal shell are disposed on the board surface and the board surface is provided with a plurality of first soldering pad portions and two second soldering pad portions, the first soldering surface of the contacting portion of each of the terminals is correspondingly fixedly soldered on one of the first soldering pad portions, and the second soldering surface of each of the soldering plates of the outer metal shell is correspondingly fixedly soldered on one of the second soldering pad portions.

4. The electrical connector according to claim 3, wherein the inner metal shell is further provided with lateral soldering legs respectively at two sides of the inner metal shell, the circuit board is provided with through-holes respectively located in the second soldering pad portions, and the lateral soldering legs are disposed to respectively pass through the through-holes located in the second soldering pad portions.

5. The electrical connector according to claim 4, wherein each of the second soldering pad portions of the circuit board has a soldering pad for one of the soldering plates and a soldering pad for one of the soldering legs, the soldering plates of the outer metal shell are fixedly soldered respectively on the soldering pads for the soldering plates, and the through-holes located in the second soldering pad portions are located respectively in the soldering pads for the soldering legs, and the lateral soldering legs of the inner metal shell are disposed to respectively pass through the through-holes located in the soldering pads for the soldering legs.

6. The electrical connector according to claim 4, wherein each of the second soldering pad portions of the circuit board is a soldering pad.

7. The electrical connector according to claim 4, wherein the inner metal shell further includes:

two side plates connected to two sides of the top plate of the inner metal shell;

a bottom plate connected to the two side plates of the inner metal shell;

a rear lid connected to a rear end of the top plate of the inner metal shell; and the lateral soldering legs are formed so as to extend downwards respectively from the two side plates of the inner metal shell.

8. The electrical connector according to claim 7, wherein the rear lid is extended with rear soldering legs, the board surface of the circuit board is provided with third soldering pad portions, and the circuit board is provided with through-holes respectively located in the third soldering pad portions, and the rear soldering legs of the rear lid are disposed to respectively pass through the through holes located in the third soldering pad portion.

9. The electrical connector according to claim 8, wherein the board surface of the circuit board is provided with fourth soldering pad portions and a bottom surface of the bottom plate of the inner metal shell close to the front end of the inner metal shell is fixedly soldered on the fourth soldering pad portions.

* * * * *